United States Patent [19]

Karol

[11] 4,431,087

[45] Feb. 14, 1984

[54] GUIDE RAIL CLAMPING METHOD AND ASSEMBLY

[75] Inventor: Herman S. Karol, Morris Township, Morris County, N.J.

[73] Assignee: Westinghouse Electric Corp., Pittsburgh, Pa.

[21] Appl. No.: 268,226

[22] Filed: May 29, 1981

[51] Int. Cl.[3] ..... B66B 7/02

[52] U.S. Cl. ..... 187/95; 238/310; 238/336; 238/337; 238/351

[58] Field of Search ..... 187/95; 238/263, 310, 238/336, 337, 351, 378; 104/127

[56] References Cited

U.S. PATENT DOCUMENTS

| | | | |
|---|---|---|---|
| 1,905,248 | 4/1933 | Skaife . | |
| 2,402,888 | 6/1946 | Hall . | |
| 2,848,077 | 8/1958 | Tofanelli . | |
| 3,199,642 | 8/1965 | Anderson | 187/95 |
| 3,335,635 | 8/1967 | Sidler . | |
| 3,420,337 | 1/1969 | Magee | 187/95 |

*Primary Examiner*—Joseph J. Rolla
*Assistant Examiner*—Thomas C. Fitzgerald
*Attorney, Agent, or Firm*—D. R. Lackey

[57] ABSTRACT

A guide rail clamping method and assembly including a rail bracket attached to a building, a tapped intermediate support member, rail clips, bolts and nuts. The bolts are turned to tightly clamp the guide rail between the rail clips and intermediate support member, to create a unitary assembly, and the nuts are turned on the bolts to tightly clamp the unitary assembly to the rail bracket. This enables the guide rails to be firmly clamped by their rail clips while the nuts are loosened to permit the guide rail to be accurately positioned in both the fore-aft direction, and B.G. direction.

8 Claims, 5 Drawing Figures

GUIDE RAIL CLAMPING METHOD AND ASSEMBLY

BACKGROUND OF THE INVENTION

1. Field of the Invention

The invention relates in general to guide rails, and more specifically to new and improved guide rail clamping methods and apparatus for attaching and accurately positioning elevator guide rails in a hatchway or hoistway of a building.

2. Description of the Prior Art

The movable elements of an elevator system, such as the elevator car and its counterweight, are guided throughout their respective travel paths in the hoistway of a building. The guiding system conventionally includes guide rails, which have a substantially T-shaped cross-sectional configuration, which rails are fixed in the hoistway, and guide elements, such as guide roller assemblies, with the guide elements being carried by the elevator car and counterweight. The guide elements coact with three guide surfaces on each of the guide rails to guide the movable elements.

When an elevator system is installed, extreme care must be taken to properly align the sections which make up each complete guide rail, to properly locate each group of aligned sections between the front and back walls of the hoistway, called the "fore-aft" axis, and to accurately space the two groups of aligned sections, called the "between guides" or B.G. axis.

The conventional T-shaped guide rail includes first and second flanges and a stem. The stem defines the three guide surfaces, one on the nose or face of the stem portion, and one on each side of the opposed surfaces of the stem.

The presently used methods and clamping apparatus for fastening elevator guide rails in hatches has been used for many years. A bracket, usually shaped like an angle, is fastened to the hatch wall or building steel. The guide rail is clamped to the bracket using clamps commonly called rail clips. These clips are of three basic types, a fixed clip, a sliding clip, and a pressed clip. The fixed clips are usually forged parts and are used for heavy-duty and/or low-rise installations. The forged clips exert high clamping forces on the rail. If the building settles, the rail will not slide through the clips. The sliding clips and pressed clips are used in higher rise buildings, to allow the rail to "slip" through the clips as the building settles, thus preventing the guide rails from distorting.

During installation of the guide rails, field personnel must "plumb" the guide rails and maintain the B.G. distance between rails within close tolerances. In order to accomplish this, the field personnel must leave the bolts, washers and nuts sufficiently loose to allow the rail to be moved on the fore-aft axis, and also loose enough to enable shims to be placed between the guide rail and rail bracket, in order to adjust and maintain the B.G. dimension. This "loose-hardware" condition is extremely difficult to work with since one axis adjustment affects the other. The rail clips sag and tend to skew on the rail. The pressed clips are mare of mild steel, and they derive their "spring" effect as a result of forming its final shape in a die. This "spring" effect is defeated if the pressed clip is mishandled while being clamped to the rail. If not held exactly in position, it will become permanently deformed. Thus, when the clips sag on the rail, it is common for them to be deformed when the bolts are tightened, and they will not firmly clamp the rail.

The "shimming" step uses special double-slotted shims placed over the hardware to maintain the proper center distance between the two rail clip bolts, which, in turn, assure that the clips remain in contact with the rail. Since guide rails are available in a plurality of different weights and dimensions, with the size of the rail being dictated by the specific application thereof, it is necessary to produce and maintain a large inventory of double-slotted shims, which are made of many thicknesses and center distances between slots to accommodate each size rail and each type of clip for each rail.

In addition to the field installation problems, the manufacture of pressed clips is both difficult and costly. Tooling maintenance is difficult and expensive.

The sliding clip, used primarily for high-rise duties, is constructed of brass, and is thus a very costly assembly to manufacture.

SUMMARY OF THE INVENTION

Briefly, the present invention includes new and improved methods and clamping apparatus for positioning and fixing elevator guide rails in the hatchway of a building. The new clamping apparatus includes a first mounting member, or rail bracket, which is fixed to the building, a second mounting member, or intermediate support member, first and second rail clip members, first and second bolts, and first and second nuts. The first and second bolts extend through openings in the first and second rail clip members, and threadably engage tapped openings in the second mounting member. The first and second bolts are tightened to firmly clamp the guide rail flanges between the second mounting member and the first and second rail clip members, which overlap the first and second flanges, respectively, of the guide rail. This forms a first or intermediate assembly. The first and second bolts continue through elongated openings in the first mounting member, and the first and second nuts are tightened on the first and second bolts, respectively, to firmly clamp the first assembly to the first mounting member, and thus to the associated building.

For a fixed clip application, the second mounting member may simply be a relatively thick steel plate, and the first and second rail clip members may be forged steel members having a relatively heavy first portion which includes a bolt-receiving opening, and a second portion which overlaps the guide rail flange. The first portions, when assembled by the bolts to the second support member, are spaced to snugly receive the width of the guide rail and thus "trap" the guide rail between these two, now firm, projections from the flat face of the intermediate support member.

For applications which normally use a sliding clip, or a pressed clip, the second mounting member, in addition to a thick steel plate having tapped openings therein, has first and second metallic projections fixed to the steel plate. The projections, which have a bolt-receiving opening aligned with a tapped opening, are spaced to snugly receive the width dimension of the associated guide rail. The rail clips are formed of flat spring steel, with a bolt-receiving opening therein.

The new and improved method of locating and fixing the guide rails, for both the fixed and sliding applications, includes fixing the first mounting member to the building or supporting structure, firmly clamping the guide rail between the second mounting member and rail clip members via the first and second bolts and tapped openings in the second mounting member, loosely attaching the resulting assembly to the first mounting member by inserting the ends of the first and second bolts through elongated openings in the first mounting member, and threadably engaging the first and second nuts with the first and second bolts. The nuts are not tightened at this point. The guide rail can now be adjusted either in the direction of the fore-aft axis, or the B.G. axis, without adversely affecting the tight rail clip-to-rail contact interface. The guide rail is shimmed to the correct B.G. distance using shims disposed between the first and second mounting members. Since the first and second bolts are already accurately spaced and firmly fixed in spaced relation, the shims need not have their bolt-receiving slots accurately positioned for the specific bolt size and bolt spacing used, thus greatly reducing the number of shims which must be manufactured. When the B.G. dimension is achieved, the location in the fore-aft axis may be plumbed, the rail "tapped" to position on the plumb line via the elongated openings in the first mounting member, and the nuts tightened to final torque. Thus, the first and second bolts provide two clamping functions, a first clamping function which clamps the guide rail between the rail clips and the intermediate support member, and a second clamping function which clamps the assembly resulting from the first clamping function to the rail bracket. The second clamping function is independent of the first, enabling the fore-aft and B.G. adjustments to be made while the guide rails are firmly clamped by the rail clips.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
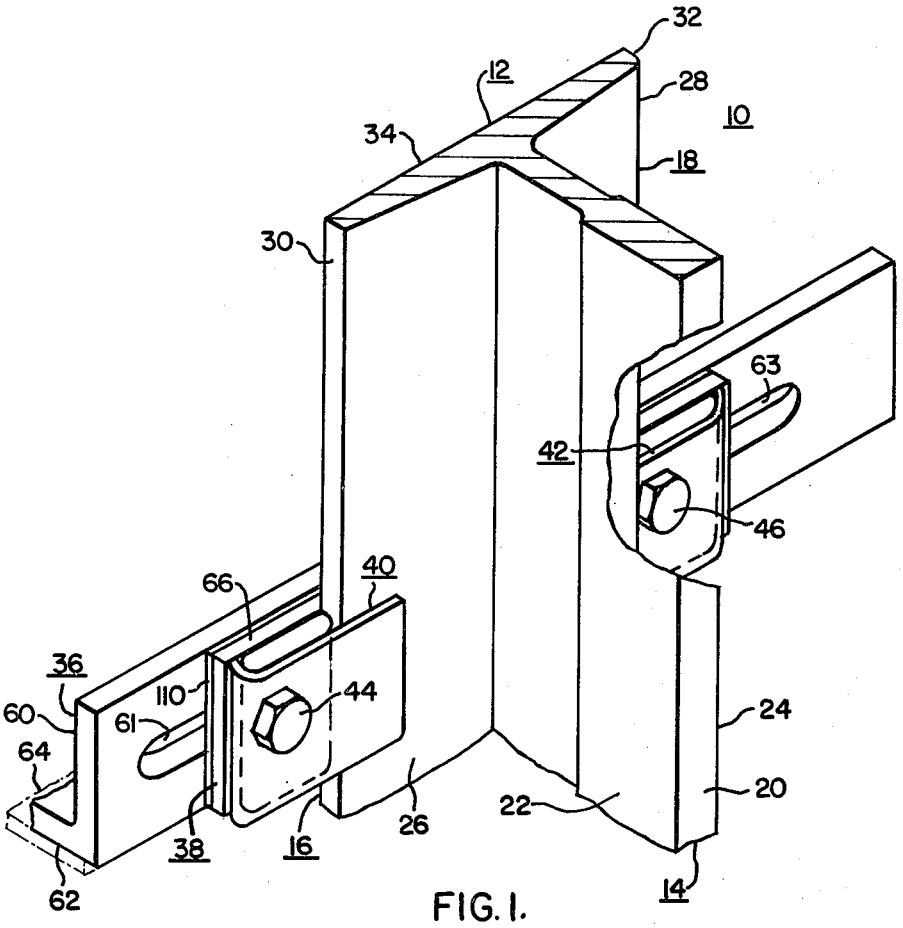
FIG. 1 is a perspective view of a guide rail clamping assembly constructed according to a first embodiment of the invention.
Figure 2:
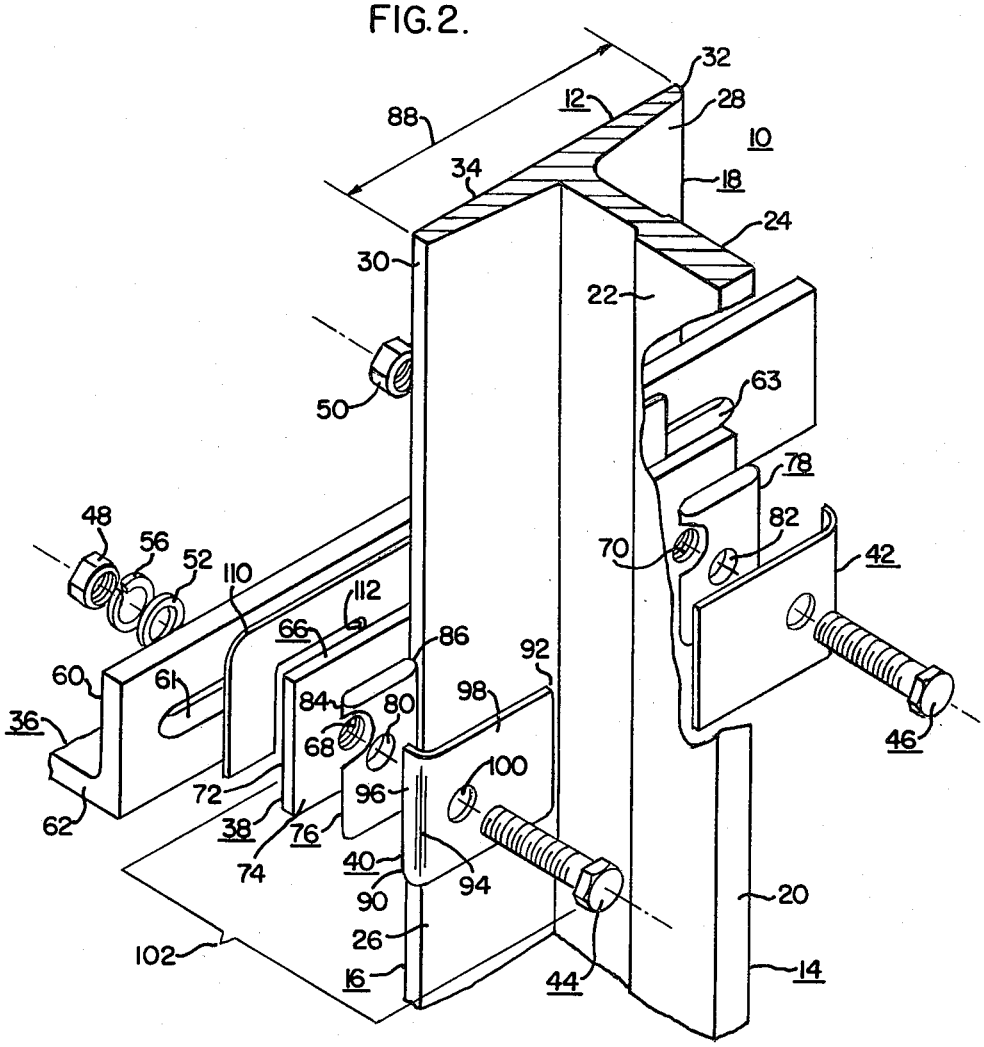
FIG. 2 is an exploded perspective view of the assembly shown in FIG. 1.
Figure 4:
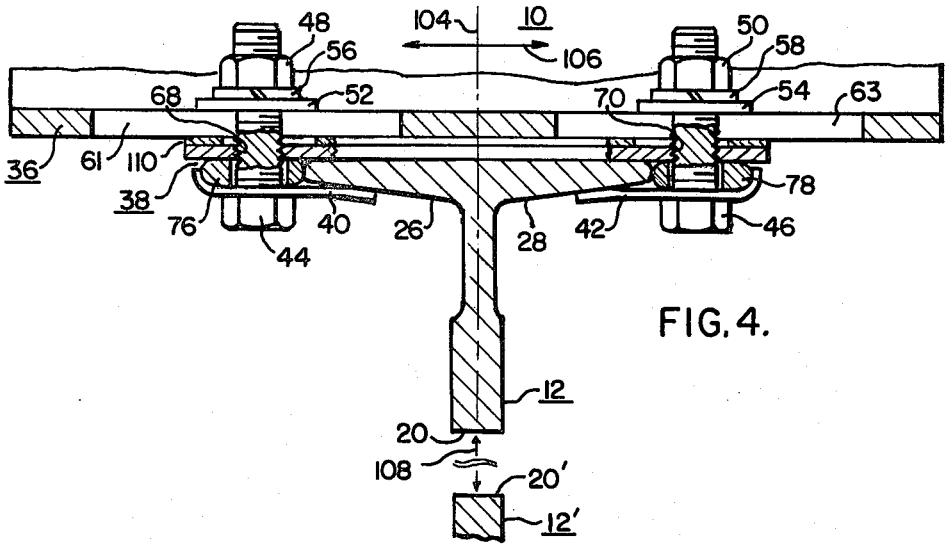
FIG. 4 is a cross-sectional plan view of the assembly shown in FIG. 1.
Figure 3:
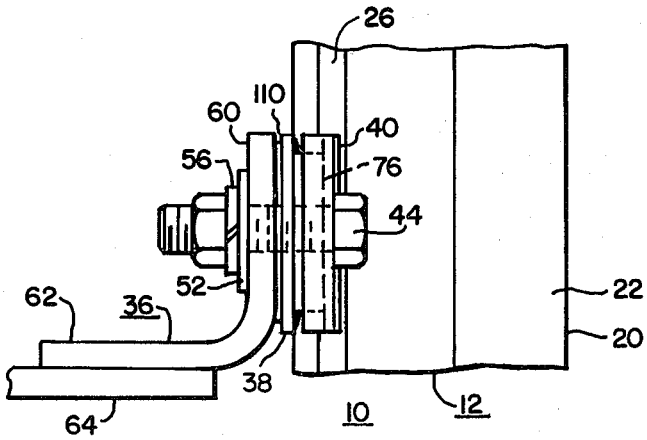
FIG. 3 is a left-hand elevational view of the guide rail clamping assembly shown in FIG. 1.

Referring now to the drawings, FIGS. 1–4 set forth a guide rail clamping assembly 10 constructed according to a first embodiment of the invention. FIG. 1 is a perspective view of the guide rail clamping assembly, FIG. 2 is an exploded perspective view, FIG. 3 is a left-side elevational view, and FIG. 4 is a cross-sectional plan view. The guide rail clamping assembly 10 allows the guide rail to "slip" as the building settles, and it thus may be used in place of the prior-art sliding clips and the prior-art pressed clips. A second embodiment of the invention, to be hereinafter described relative to FIG. 5, sets forth a fixed clip embodiment of the invention, which may be used for low-rise and/or heavy-duty applications.

More specifically, guide rail clamping assembly 10 includes a guide rail 12 which has a substantially T-shaped cross-sectional configuration. Guide rail 12 includes a stem portion 14 and first and second flanges 16 and 18, respectively, disposed on opposite sides of the stem portion 14. The stem portion 14 includes a nose or face guide surface 20, and first and second opposed side guide surfaces 22 and 24, respectively. The first and second flanges include front surfaces 26 and 28, respectively, side or lateral edges 30 and 32, respectively, and back portions which lie in a common plane and are thus referenced with a single reference 34.

The elements of the clamping assembly 10 which perform the function of securing guide rail 12 in a building hatchway include a first mounting member 36, conventionally referred to as a rail bracket, a second mounting member 38, which may also be referred to as an intermediate support member, first and second rail clip members 40 and 42, respectively, first and second bolts 44 and 46, respectively, and first and second nuts 48 and 50, respectively. Additional fastener hardware may be used, such as first and second washers 52 and 54, respectively, and first and second lock washers 56 and 58, respectively.

The rail bracket 36, which may be a right angle metallic member as shown in FIG. 1, or a channel-shaped member, includes a vertically oriented leg portion 60 for connection to the guide rail 12, and a horizontally oriented leg portion 62 for connection to a support structure 64, which is shown in phantom in FIG. 1. The support structure 64 is part of the associated building. At least one elongated opening or slot is provided in leg 60. In a preferred embodiment of the invention, first and second elongated slots or openings 61 and 63 are provided. However, one long slot may be provided, if desired.

The intermediate support member 38 includes a flat plate or sheet member 66 formed of metal, such as steel. First and second drilled and tapped openings 68 and 70, respectively, are provided in plate member 66, in predetermined spaced relation, with the openings extending between first and second major, flat, parallel-opposed surfaces 72 and 74, respectively, of plate member 66. The second surface 74 includes first and second metallic projecting portions 76 and 78 suitably fixed thereto, such as by welding, having openings 80 and 82, respectively, which are aligned with tapped openings 68 and 70, respectively. Projecting portions 76 and 78 may be steel bars with their lateral edges preferably being curved or rounded, such as illustrated at 84 and 86 relative to projecting portion 76. The spacing between the facing lateral edges of the projecting portions 76 and 78 is selected to snugly receive the width dimension 88 of the guide rail 12, with this width dimension being illustrated in FIG. 2.

The first and second rail clip members 40 and 42 are formed of flat spring steel. Since the rail clip members are of like construction, only rail clip member 40 will be described in detail. Rail clip 40 has first and second lateral edges 90 nd 92, with a permanent curved bend 94 being formed adjacent to edge 90. The spacing of bend 94 from edge 90 is selected such that it will conform to the curved edge 84 of a projecting portion, such as projecting portion 76, without contacting the surface 74 of plate member 66. Thus, bend 94 creates a relatively short leg portion 96 which curves about a projecting portion to properly align the rail clip, and it also creates a relatively long, straight leg portion 98 which overlaps and contacts a flange of guide rail 12. An opening 100 is formed in leg portion 98, adjacent to bend 94.

The new and improved method of clamping a guide rail will be described as the assembly of the various elements of the guide rail assembly is described. The rail brackets 36 are fixed to the building using a plumb line to orient the centers of the rail brackets. The upper surface of leg 60 may be suitably grooved to aid in the locating process. An intermediate support member 38 is placed on a guide rail section, with the back 34 of the guide rail section 12 being disposed against the front surface 74 of plate member 66. The spacing between projecting portions 76 and 78 snugly accepts the guide rail dimension 88 between its lateral edges, which properly orients the intermediate support member 38 and allows it to be positioned vertically along the guide rail to achieve the location of a rail bracket. Bolts 44 and 46 are inserted through the openings 100 in rail clip members 40 and 42, and the bolts 44 and 46 are then threadably engaged with tapped openings 68 and 70, respectively, in the intermediate support member 38. The bolts 44 and 46 are initially only finger tightened, if the intermediate support member and clips are first applied to the rails in the pit. This will permit the intermediate support member 38 and its clips to be pushed along the associated rail section to the location of a rail bracket once the rail sections are in the proper position in the hatchway. After the bolts 44 and 46 are aligned with the slot, or slots, in the rail bracket 36, they are firmly tightened to cause the rail clips 40 and 42 to press against the flanges 26 and 28 and flex or bend slightly, as shown in FIG. 4, to apply a resilient spring pressure which clamp the guide rail sections 12 tightly between the rail clips and the intermediate support member. The flat spring steel clip does not require the precise location of the prior-art pressed clip, as it cannot become deformed during installation. The resilient clamping pressure, while firm, enables the rail to slip with the settling of the building, to thus prevent distortion of the guide rail. The bolts 44 and 46 are selected to have a length dimension sufficient to extend outwardly past surface 72 of the intermediate support member 38, and through the elongated openings 61 and 63, respectively.

The tightening of the bolts completes a first clamping function of bolts 44 and 46, and a first unitary assembly 102 is provided which includes the guide rail section 12 firmly clamped between the intermediate support member 38 and the rail clip members 40 and 42. The bolts 44 and 46 are accurately spaced and they form two solid, immovable, post-like projections on assembly 102 which extend through the adjustment slots 61 and 63 of the rail bracket 36.

As shown in FIG. 4, guide rail section 12 must be properly aligned on center line 104, and thus the position of guide rail section 12 must be adjustable along the fore-aft axis indicated at 106. The location of center line 104 may be established by a plumb line. A second critical adjustment of the guide rail 12 is the spacing 108 between the nose 20 of guide rail section 12 and the nose 20' of a guide rail section 12' located on the other side of the hatchway. This is the B.G. dimension. The proper location of nose 20 which will provide the proper B.G. dimension, may also be established by the plumb line. Assembly 102 is now free to move in either the fore-aft axis 104, or the B.G. axis 108, without adversely affecting the rail clip-to-guide rail contact. The washers 52 and 54, lock washers 56 and 58, and nuts 48 and 50, may now be assembled with bolts 44 and 46, with the nuts left untightened. The nose 20 of the guide rail section is shimmed to the plumb line using one or more shims, such as shim 110. The present invention, wherein the guide rail is "trapped" between projections 76 and 78, and wherein the bolts are firm, post-like accurately spaced projections, greatly reduces the number of different shims which must be manufactured. Each size of shim may be manufactured such that it may be used with more than one size of guide rail. In the prior art, the bolts are not firmly held in spaced relation because they are not tightened against the rail clips at this point in the assembly. Thus, the prior-art shims have first- and second-spaced slots formed to snugly receive the bolts, and thus properly orient and space the bolts. As illustrated in FIG. 2, the bolt slots, such as slot 112 in shim 110, may be wide enough to accommodate a plurality of different bolt spacings, as the bolts are already firmly held and properly positioned. A single long opening or slot may also be used in shim 110, if desired, instead of two relatively wide slots.

When the nose 20 of guide rail section 12 is shimmed to the plumb line, the assembly 102 may now be adjusted in the direction of the fore-aft axis to place the center of the nose 20 on the plumb line, and the nuts are tightened to final torque to firmly clamp the assembly 102 to the guide rail bracket 36. This clamping function of bolts 44 and 46, which is independent of the first clamping function, thus holds the guide rail section 12 in the precise fore-aft and B.G. locations.

Figure 5:
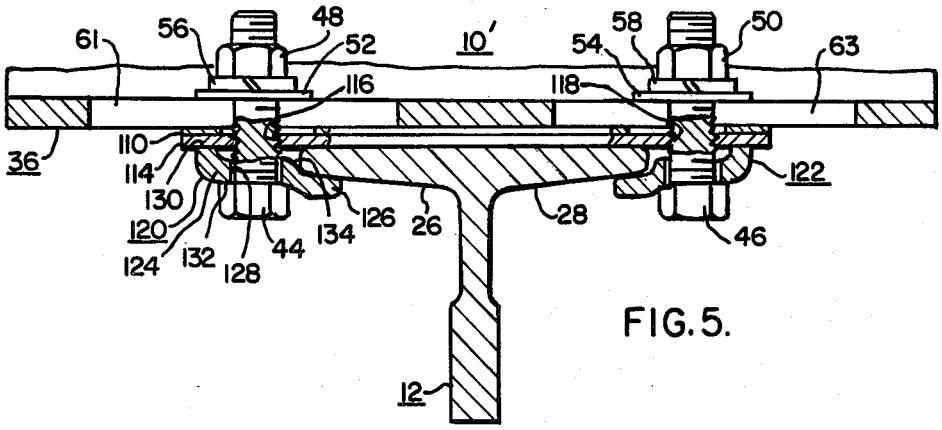
FIG. 5 is a cross-sectional plan view, similar to that of FIG. 4, except modified to illustrate an embodiment of the invention which uses fixed rail clips instead of sliding rail clips.

The invention set forth in FIGS. 1–4 and hereinbefore described replaces the prior-art sliding clips and prior-art pressed clips, and it has manufacturing and installation advantages over both, being much simpler to manufacture and much easier to install in the field, as well as having a lower initial cost. The principles of the invention may also be advantageously applied to applications requiring a fixed, i.e., a heavy-duty application and/or a low-rise application where building settling is not a problem. FIG. 5 is a cross-sectional plan view of a guide rail clamping assembly 10' which is similar to the assembly 10 shown in FIG. 4, except the intermediate support member and rail clips are modified. Since the other elements may be the same as in the FIGS. 1–4 embodiment, only the modified elements will be described in detail.

In the guide rail assembly 10', an intermediate support member 114 is provided which is similar to the plate member 66 of the intermediate support member 38 of the first embodiment. The projecting portions 76 and 78 required by the first embodiment, are not required in this embodiment. Similar to plate member 66, intermediate support member 114 includes first and second tapped openings 116 and 118, respectively. First and second rail clip members 120 and 122 are provided, which may be forged steel. Since each is of similar construction, only rail clip member 120 will be described in detail. Rail clip member 120 includes first and second basic portions 124 and 126, respectively. Portion 124, which includes a bolt-receiving opening 128, has a flat surface 130 rests against the intermediate support member 114, and a flat surface 132 at one end of opening 128 which receives the underside of a bolt head, such as the head of bolt 128. Portion 124 provides the function of the projecting portions 76 and 78 of the intermediate support member of the first embodiment, and as such, it includes a surface 134 for cooperating with the edge of a guide rail flange. When the rail clip members 120 and 122 are pressed tightly against the guide rail, the surfaces 134 "trap" the guide rail in the direction of the fore-aft axis, in a manner similar to that of the projections 76 and 78 of the first embodiment.

The second portion 126 extends integrally outward from the first portion 124 and it overlaps the flange of the guide rail. The second portion presses tightly against the flange when its associated bolt is tightened, to provide a strong clamping force for heavy-duty applications. The clamping force is so strong that it will not allow the rail to slip, should the building settle, and it is thus not used in high-rise applications. The embodiment of FIG. 5 possesses the same advantages as the first embodiment, and enables the same new and improved assembly method to be used, which includes the two sequential clamping functions to be performed, as hereinbefore described relative to the first embodiment.

I claim as my invention:

1. A guide rail clamping assembly for fixing rail clips to an elevator guide rail while facilitating both fore-aft and between guide (BG) adjustement of the guide rail relative to a support structure, comprising:

a first mounting member fastened to the supporting structure, said first mounting member including elongated opening means, a second mounting member having first and second tapped openings therein, said second mounting member being adjacent to said first mounting member, with its first and second tapped openings aligned with the elongated opening means, a guide rail section having first and second flanges, the backs of which contact said mounting member, first and second rail clip members engaging the first and second flanges, respectively, of said guide rail section, with said first and second rail clip members including an opening aligned with the first and second tapped openings, respectively, of said second mounting member, first and second bolts extending through the openings in the first and second rail clip members, respectively, and threadably, engaging the first and second tapped openings, respectively, in the second mounting member, to tightly clamp and thereby lock the first and second flanges of the guide rail section between the second mounting member and the first and second rail clip members, to provide a first clamping function associated with the first and second bolts which prevents relative motion between said second mounting member, said guide rail section, said first and second rail clip members, and said first and second bolts, including the prevention of any relative motion in the axial direction of said first and second bolts, said first and second bolts further extending through the elongated opening means in the first mounting member, permitting fore-aft and BG adjustment of the guide rail section without releasing the lock on the first and second flanges created by the second mounting member, the first and second rail clip members, and the first and second bolts, and first and second nuts threadably engaged with the first and second bolts, respectively, to clamp the rail clip members, guide rail section, and second mounting member, to the first mounting member and provide a second clamping function associated with said first and second bolts, which is independent of the first clamping function.

2. The guide rail clamping assembly of claim 1 wherein the second mounting member is a flat member, and the first and second rail clip members each include first portions which provide a fixed dimension between them selected to snugly trap the guide rail section when the first and second bolts are advanced to perform their first clamping function, and second portions which overlap and clamp the flanges of the guide rail section.

3. The guide rail clamping assembly of claim 1 including at least one shim member disposed between the first and second mounting members.

4. The guide rail clamping assembly of claim 1 wherein the rail clip members are each formed of flat spring steel.

5. The guide rail clamping assembly of claim 2 wherein the second mounting member includes a flat portion in which the first and second tapped openings are provided, and first and second spaced projecting portions fixed to said flat portion having openings aligned with the first and second tapped openings, respectively, with the spacing between the projecting portions being selected to snugly accept the width of the associated guide rail section.

6. A method of attaching and locating a guide rail for an elevator, comprising the steps of:

fixing a rail bracket to supporting structure, firmly clamping a guide rail to an intermediate support member via a first rail clip member, and a second rail clip member, and first and second bolts to provided a first assembly in which relative motion between the intermediate support member, said guide rail, said first and second rail clip members and said first and second bolts is prevented, including the prevention of any relative motion in the axial direction of the first and second bolts, loosely attaching the first assembly to the rail bracket, shimming the space between the rail bracket and first assembly to a desired B.G. dimension, sliding the first assembly laterally relative to the rail bracket to a required fore-aft location, and firmly clamping the first assembly to the rail bracket.

7. The method of claim 6 wherein the step of firmly clamping the guide rail between the rail clips and an intermediate support member includes inserting said first and second bolts through openings in the first and second rail clips, respectively, and threadably engaging tapped openings disposed in the intermediate support member.

8. The method of claim 6 wherein the step of loosely attaching the first assembly to the rail bracket includes the steps of inserting the ends of the first and second bolts through elongated openings in the rail bracket and threadably engaging them with first and second nuts, respectively, and the step of firmly clamping the first assembly to the rail bracket includes the step of tightening the first and second nuts.

* * * * *